US009919327B2

(12) United States Patent
Dutton

(10) Patent No.: US 9,919,327 B2
(45) Date of Patent: Mar. 20, 2018

(54) LIVING HINGE ACTUATOR

(71) Applicant: Avon Products, Inc., Suffern, NY (US)

(72) Inventor: Simon Nicholas Dutton, New City, NY (US)

(73) Assignee: Avon Products, Inc., Rye, NY (US)

( * ) Notice: Subject to any disclaimer, the term of this patent is extended or adjusted under 35 U.S.C. 154(b) by 2 days.

(21) Appl. No.: 15/188,474

(22) Filed: Jun. 21, 2016

(65) Prior Publication Data

US 2017/0361344 A1 Dec. 21, 2017

(51) Int. Cl.
*B05B 11/00* (2006.01)
*B05B 15/00* (2018.01)

(52) U.S. Cl.
CPC ..... *B05B 11/3052* (2013.01); *B05B 11/3025* (2013.01); *B05B 11/3047* (2013.01); *B05B 11/3073* (2013.01); *B05B 11/3074* (2013.01); *B05B 11/3077* (2013.01); *B05B 15/005* (2013.01)

(58) Field of Classification Search
CPC ..... B05B 11/3052; B05B 11/3074; B05B 11/3073; B05B 11/3076; B05B 11/3077; B05B 11/3025; B05B 11/3047; B05B 15/005; B65D 83/206
See application file for complete search history.

(56) References Cited

U.S. PATENT DOCUMENTS 4,978,035 A * 12/1990 Morane ..... B05B 11/3097 222/108
5,363,993 A * 11/1994 Mascitelli ..... B05B 11/0013 222/153.09
5,673,824 A * 10/1997 Evans ..... B05B 11/0005 222/321.1
5,687,884 A * 11/1997 Bodin ..... B05B 11/0043 222/321.7
5,704,519 A * 1/1998 Crosnier ..... B05B 11/007 222/207
D424,441 S * 5/2000 Santagiuliana ..... D9/448
6,193,112 B1 * 2/2001 Santagiuliana ..... B05B 11/3059 222/153.13
6,742,717 B2 6/2004 Aberegg et al.
7,487,891 B2 2/2009 Yerby et al.
8,550,306 B2 10/2013 Angus et al.
8,881,944 B2 11/2014 Paas et al.
8,936,180 B2 1/2015 Sell
8,978,936 B2 3/2015 Eini et al.
8,998,041 B2 4/2015 Strand
(Continued)

FOREIGN PATENT DOCUMENTS

WO 2015017306 A1 2/2015

*Primary Examiner* — Patrick M Buechner
(74) *Attorney, Agent, or Firm* — Brian P. McCloskey; Elizabeth M. Morters

(57) ABSTRACT

The invention relates generally to a device for actuating a pump mechanism capable of expelling a flowable composition from a container reservoir. In particular, the actuation capability is derived from a living hinge which is constituted by an elastomeric region of the actuator. More specifically, the invention relates to a molded actuator having a button portion for pressing, a collar portion for securing to a container, and a living hinge portion formed of a material that is sufficiently pliable to allow movement of the button portion relative to the collar in a resilient manner.

17 Claims, 5 Drawing Sheets

(56) References Cited

U.S. PATENT DOCUMENTS

| | | | | |
|---|---|---|---|---|
| 2001/0054626 | A1* | 12/2001 | Bethune | B05B 11/3042 222/340 |
| 2003/0075567 | A1* | 4/2003 | Santagiuliana | B05B 11/0016 222/380 |
| 2003/0116588 | A1* | 6/2003 | Santagiuliana | B05B 11/3007 222/321.9 |
| 2005/0279771 | A1* | 12/2005 | Mira Navarro | B05B 11/3001 222/321.9 |
| 2007/0007309 | A1* | 1/2007 | Eberhardt | B65D 83/206 222/402.13 |
| 2010/0133300 | A1* | 6/2010 | van der Heijden | B05B 7/0018 222/190 |
| 2013/0037582 | A1 | 2/2013 | Andersen et al. | |
| 2013/0146611 | A1 | 6/2013 | Sell | |
| 2013/0336824 | A1* | 12/2013 | Boes | B05B 11/3033 417/472 |
| 2015/0166250 | A1 | 6/2015 | Brace et al. | |

* cited by examiner

LIVING HINGE ACTUATOR

FIELD OF INVENTION

The invention relates generally to a device for actuating a pump mechanism capable of expelling a flowable composition from a container reservoir. In particular, the actuation capability is derived from a living hinge which is constituted by an elastomeric region of the actuator. More specifically, the invention relates to a molded actuator having a button portion for pressing, a collar portion for securing to a container, and a living hinge portion formed of a material that is sufficiently pliable to allow movement of the button portion relative to the collar in a resilient manner.

BACKGROUND

Pumps are commonly used for dispensing liquids and gases from small hand held personal care containers, especially fragrances, sunscreens, insect repellants and the like. Typically, a personal care product will have a container of product and a pump and actuator assembly affixed to the container. In the type of pump known as an atmospheric pump, a dip stick extends into the container and in contact with the flowable composition. When the pump is actuated, pressure within the container forces the liquid up through the dip stick, through a valve seated on the container, and out through an outlet orifice which is usually on the actuator button. In some embodiments, the exit orifice is on the collar portion. A coiled metal spring is usually disposed between the actuator button and the container body and surrounding the exit tube to provide a counterforce when the actuator button is engaged by the user. The dip stick, valve, and pump assembly are not intended to be reused and are intended to be disposed of with the container when the product is depleted from the container.

It is an object of the present invention to provide a living hinge actuator that can actuate a pump mechanism. It is a further object of the invention to provide a pump actuator for a personal care container, of the type adapted to actuate an atmospheric pump, which may be removably affixed to a plurality of containers having a valve and dipstick assembly, such that the actuator engages and opens the valve when depressed by force from a user's finger or thumb, and closes the valve when the force is released. It is a further object of the invention to provide a system comprising a reusable actuator and a plurality of containers to which the actuator may be reversibly secured to enable dispensing of fluid contents from the plurality of containers, wherein each container comprises a reservoir charged with a flowable personal care product (e.g., a fragrance composition), a valve affixed to said container, and a dipstick in fluid communication with the charge of flowable product and the valve. Advantageously, the system reduces the number of parts required for manufacture of each fragrance container and enables the pump assembly to be used with refillable or replaceable product cartridges or containers.

The foregoing discussion is presented solely to provide a better understanding of the nature of the problems confronting the art and should not be construed in any way as an admission as to prior art nor should the citation of any reference herein be construed as an admission that such reference constitutes "prior art" to the instant application.

SUMMARY OF THE INVENTION

In accordance with one or more of the foregoing objectives and others, the present invention provides an actuator that operates on the principle of a "living hinge," by which is meant that a thin flexible hinge (flexure bearing) made from the same material as the two pieces it connects. In some implementation, the living hinge is composed of an elastomeric material (e.g., a plastic, such as a polyolefin), which may be any material sufficiently pliable and resilient to be deformed by a force and return substantially to original position after removal of the force.

In one aspect of the invention, a pump actuator is provided comprising a button portion; a collar portion having a top end, a bottom end, and a continuous wall defining a lumen therein, the bottom end being optionally adapted to secure the actuator to a container so as to engage and actuate a pump on the container that is in fluid communication with a container reservoir containing a flowable material; and an elastomeric sleeve connecting the button portion to the collar portion so as to form a living hinge between the button and collar. The button, sleeve, and collar are typically a unitary piece, formed from a single mold (e.g., by injection molding). The sleeve portion will have discontinuities that permit it to collapse in an orderly manner at least partially within the lumen of the collar portion. These discontinuities may be, for example, in the form of a plurality of vertical slits or cutouts formed through the sleeve and disposed around the circumference thereof, such that the remaining material between each adjacent slit has the character of strips or bands of plastic material that are ideally substantially longer than they are wide.

The button portion, collar portion, and sleeve may be formed from a single mold such that they exit the mold in a molded configuration in which the unitary body comprises, in series, the button portion, the sleeve portion, and the collar portion (i.e., the button portion is separated from the top end of said collar portion by a length of said sleeve portion), but, upon removal from the mold, may be configured in an assembled configuration in which the sleeve collapses at least partially within the lumen of the collar to provide a living hinge between the collar and the button. In this assembled configuration, the actuator is configured to be operated by a user depressing the button portion with her fingers. The underside of the button typically engages a stem or tube which, when depressed by the button, causes a pump valve to open thereby releasing the contents of the container. The living hinge is sufficiently resilient to provide a counterforce to the force of the user's finger pressing the button. Ideally, but not necessarily, the living hinge is sufficiently resilient to cause the button to substantially return to its undepressed state upon removal of the force. In the molded configuration, the length of the sleeve portion may be from about 0.5 cm to about 10 cm (e.g., from about 1-5 cm, etc.).

In some implementations, the actuator is composed of a single material, such as a thermoplastic polymer (e.g., polypropylene), such that the button, sleeve, and color all have some degree of elasticity. However, the actuator may also be formed as a unitary body from a single mold by bi-injection molding, such that at least one of the button, sleeve, and collar have a different composition that the others. For example, the button and collar portions may be formed of a rigid polymer whereas the sleeve may be formed of a comparatively less rigid or more flexible polymeric material.

The collar portion may be adapted to mechanically secure to a container, for example via elements on the collar that engage with complementary elements on the container, such as for example, complementary threading, complementary protuberances and indentations, complementary tongues and grooves, etc. Typically, the collar portion is adapted to be reversibly secured to the container so that actuator can be repeatedly removed from the container and replaced on a new container having the same complementary elements to engage the actuator. The actuator can typically be removed by forces typically applied by a user's hands without the need for tools or the like. In some embodiments, a plurality of containers is provided, each container having a reservoir filled with a flowable composition (e.g., a cosmetic fragrance serum, oil, lotion, or gel), and a pump mechanism affixed to the container. In some embodiments, the pump mechanism will include a flow valve and a dip stick connected to the internal side of the valve on its one end and dipping into the composition on the other. The containers may further comprises an exit tube connected to the external side of the valve, optionally a metal spring surrounding the exit tube, and a cage or other intermediately assembly for holding the valve and exit tube onto the container. The collar portion may secure either to the body of the container or to the cage, which for the purposes of the present disclosure is considered part of the container unless otherwise indicated. In some embodiments, the collar portion has a generally annular configuration having an interior wall defining a lumen therein, in which the sleeve portion is partially disposed in the assembled configuration. The button portion may be approximately coplanar with the top end of the collar portion in the assembled configuration, and may be configured on the underside thereof to engage the stem or tube (e.g., via a mold feature) such that the valve is caused to open when the button is depressed.

The single-bodied pump actuator is converted into a structure comprising a living hinge in the assembled configuration, wherein the elastic nature of the living hinge arises from the folding or collapse of the sleeve within the collar lumen. The button portion may have any shape, for example, a generally discoid shape or comprising a generally planar, discoid surface for engaging with the user's finger. In some embodiments, the button will have a generally discoid surface with a diameter between about 0.5-10 cm (or from about 1-5 cm). In some embodiments, the button portion is rigid or is composed of a material comparatively more rigid than the sleeve portion. In other embodiments, the button portion is also flexible such that the user experiences a resilient, rubbery feel when pressing the button. In some embodiments, the actuator may be engaged directly from a user's fingers, whereas in other embodiments, the actuator may be engaged indirectly from a user's fingers by engaging a movable member disposed between the button and the user's fingers (e.g., a flexible membrane or cap overlaying or covering the button).

In another embodiment, a kit is provided comprising a reusable actuator assembly according to the invention and a plurality of containers, each comprising a flowable composition. The plurality of compositions may be fragrance compositions, by which is meant that the primary intended benefit of the composition is to provide an odor. The compositions may be the same or different from one another. The compositions may be in the form of gels, oils, emulsions, or serums. In some embodiments, the compositions are thixotropic or shear thinning, and may have viscosities from about 10 to 1,000,000 cps at 25° C. and a shear rate of 10 l/s. In some embodiments, at least two containers in the kit will be of identical construction. In some embodiments, at least two containers in the kit comprise the same flowable composition. In some embodiments, at least two containers in the kit comprise different flowable compositions. In some embodiments, the kit will further include written instructions for assembling the actuator onto a container. In some embodiments, the kit will further include written instructions for removing the actuator from a spent container and reassembling it onto a new container.

These and other aspects of the present invention will be better understood by reference to the following detailed description and appended claims.

DETAILED DESCRIPTION OF THE INVENTION

Detailed embodiments of the present invention are disclosed herein; it is to be understood that the disclosed embodiments are merely illustrative of the invention that may be embodied in various forms. In addition, each of the examples given in connection with the various embodiments of the invention is intended to illustrative, and not restrictive. Therefore, specific structural and functional details disclosed herein are not to be interpreted as limiting, but merely as a representative basis for teaching one skilled in the art to employ the present invention.

The inventive pump actuator includes at least one portion that may comprise a living hinge. This living hinge provides the functionality necessary to actuate a pump mechanism on a personal care product container having a pump for dispensing a flowable (e.g., liquid) product. The pump actuator may be created in a molded configuration from a single mold, by injection molding or the like. In the molded configuration the molded body does not have a living hinge, but must be converted into an assembled configuration comprising the living hinge. This is typically done by pressing the button portion downward toward the collar portion such that the sleeve portion folds up within the lumen of the collar portion to form a resilient, elastic component. Any material capable of creating a living hinge may be used for molding the actuator, for example, by injection molding. In some embodiments, the actuator is bi-injection molded in order to make different potions of the actuator out of different polymeric compositions.

Figure 1:
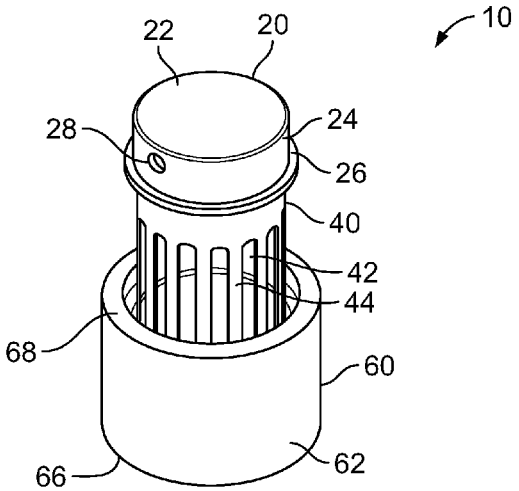
FIG. 1 is a perspective view of an embodiment of the present invention in a molded configuration.

Referring to FIG. 1, a pump actuator 10 is illustrated in the "molded configuration" by which is meant that it is in substantially the same configuration as the mold from which it was made. As shown, actuator 10 comprises a button portion 20, a sleeve portion 40 and a collar portion 60. In this embodiment, the button portion 20 is shown as having a generally annular discoid surface 22 and a vertical wall 24. As illustrated, the button portion 20 comprises a lip 26 which prevents the button from escaping the lumen of the collar portion 64 when assembled and to prevent displacement of the button during actuation. The button portion additionally comprises an orifice 28 for dispensing a flowable material. The button portion 20 is separated from the collar portion 60 by the sleeve 40. In the embodiment depicted, the sleeve comprises elongated voids or slits 42 as engineered faults. The elongated dimension is oriented parallel to the axis defined by the center of the button discoid surface 22 and the center of the surface defined by the bottom of the collar portion 66. Between the elongated voids 42 are strips or bands 44 of material which are typically longer than their width. The sleeve portion 40 is connected to the collar portion 60 via a U-shaped inverted connection 66 within the lumen 64 of the collar 60 connecting the sleeve 40 to the top of the collar 68. The collar portion 60 is generally annular comprising a lumen 64 and an annular wall 62.

Figures 2A, 2B, 2C:
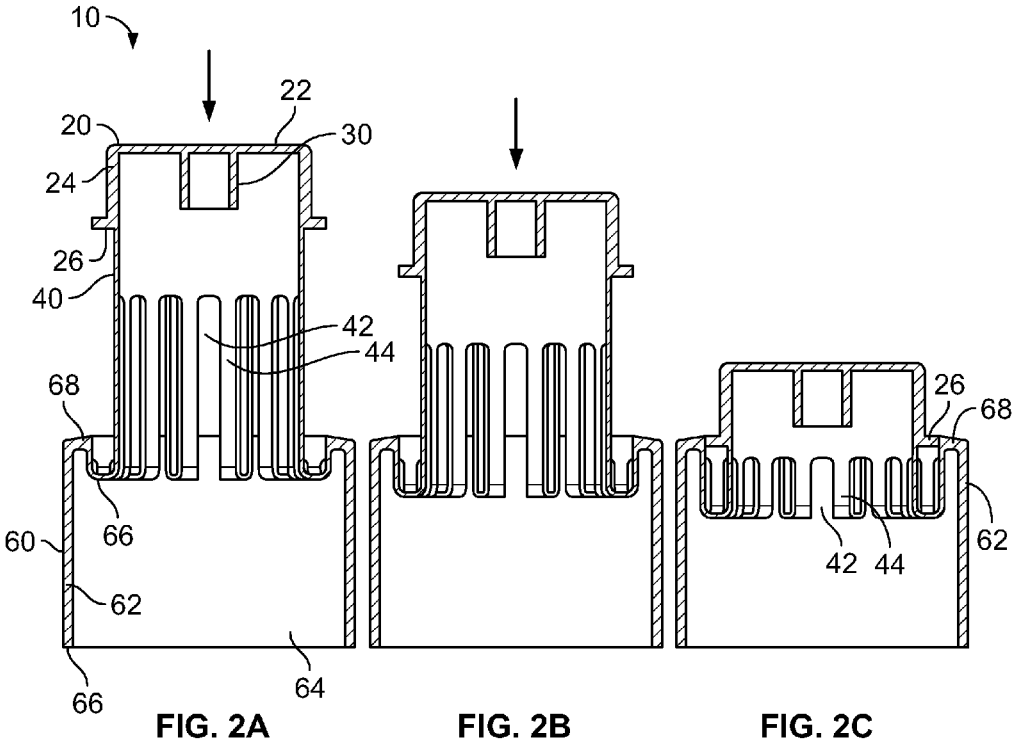
FIGS. 2A, 2B, and 2C are cross sectional side views of the embodiment of FIG. 1 showing a conversion from a molded configuration to an assembled configuration.

Referring now to FIG. 2, the actuator of FIG. 1 is shown in which a force represented by the downward arrow is exerted onto the button causing the bands 44 to collapse in a somewhat ordered manner within the lumen, such that a living hinge is formed in FIG. 2C. FIG. 2A depict the actuator 10 substantially in the molded configuration and FIG. 2C depicts the actuator in the assembled configuration. Creation of the living hinge by collapsing voids 42 and bands 44 causes a part of the button portion 20 to be able to be depressed within the lumen 64. In the depicted embodiment, the lip 26 forms a substantially continuous surface with the top of the collar 68 when the actuator 10 is in the assembled configuration (FIG. 2C).

In other exemplary embodiments, the elastomeric sleeve may comprise engineered faults of various configurations (e.g. holes, cavities, openings, shutoffs, scoring, columns, voids, weak points, ribs, accordion folds, etc.) that allow a conversion of the assembled sleeve into a living hinge. What is important is that the sleeve will have some degree of elasticity in the assembled configuration to allow the button to be depressed by the user and to provide a counterforce when the button is depressed such that the user experiences the feeling of a spring mechanism. In some embodiments, the engineered faults are ribs. In some embodiments, the engineered faults are columns. In some embodiments, multiple types of engineered faults are used to control the smoothness of the actuation mechanism at different positions during depression. In some embodiments a single living hinge is created. In some embodiments multiple living hinges can be created (e.g. two, three, etc.). In some embodiments, the engineered faults may vary in size. In some embodiments the engineered faults are equally spaced around the periphery of the sleeve. In some embodiments, the engineered faults are symmetric around the periphery of the sleeve. In some embodiments, the engineered faults are not symmetric around the periphery of the sleeve. In some embodiments, the engineered faults are centered around the midpoint of the sleeve between the collar and the button portions. In some embodiments the engineered faults are not centered between the collar and the button portions. In some embodiments, the engineered faults begin at the point in the sleeve connected to the collar. In some embodiments, the engineered faults comprise a plurality of elongated slits or voids in the sleeve. The voids may be of any shape, for example, rectangular, rounded rectangular, ovoid, polygonal, or triangular. In some embodiments, the longest dimension in the perimeter of the void is defined as the elongated dimension. The elongated dimension may be greater than 0.1 cm or 0.5 cm or 1.0 cm or 1.5 cm or 2 cm up to the approximate length of the sleeve portion. The plurality of elongated voids may form bands of material between any two adjacent voids, where the length of the band may be substantially greater than the width defined by the distance between adjacent voids. In some embodiments the width of the band is equal to the width of the void. In some embodiments, the width of the band is greater than or less than the width of the void. In some embodiments the width of the band and/or the elongated void is greater than about 0.5 mm or about 1 mm or about 5 mm up to about 1 mm or about 2 mm, or about 5 mm or about 10 mm. The elongated voids may be oriented such that the elongated dimension is substantially parallel with the axis defined by the center of the collar portion and the center of the button portion. The elongated voids may be oriented such that the elongated dimension is substantially perpendicular with the axis defined by the center of the color portion and the center of the button portion. The elongated voids may be oriented at any angle with respect to the axis defined by the center of the collar portion and the center of the button portion. The elongated voids may be all of the same size. The elongated voids may vary in size.

Figure 3:
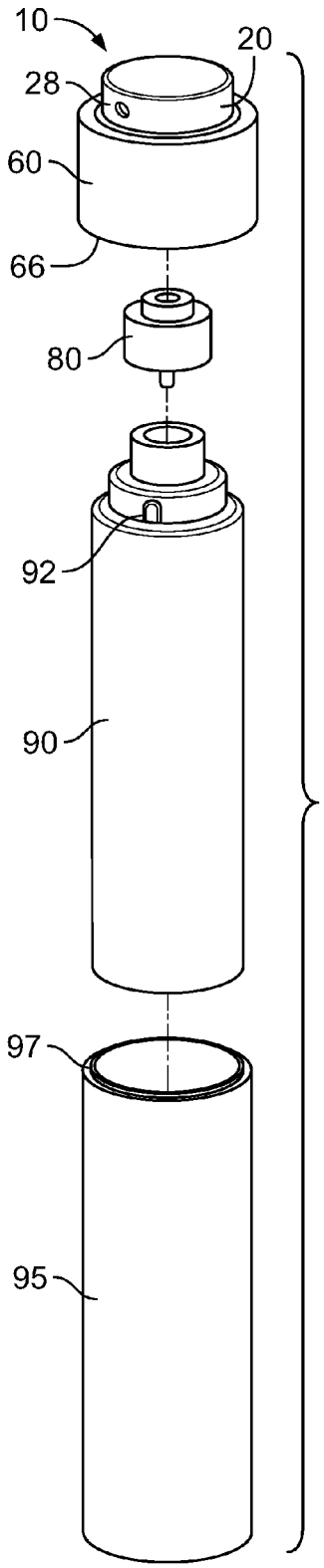
FIG. 3 is an exploded view of a pump assembly of the current invention comprising the pump actuator in an assembled configuration from FIG. 2C.
Figure 4:
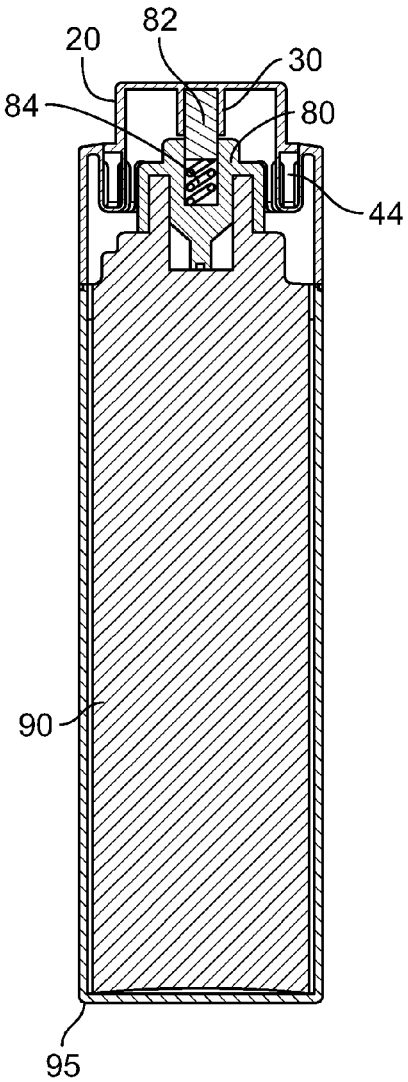
FIG. 4 is a cross sectional side view of the exploded view of FIG. 3.

Referring to FIGS. 3 and 4, a packaged assembly comprising an pump actuator 10 in an assembled configuration (FIG. 2C), pump mechanism 80, a reservoir 90 and a cage 95 is shown. FIG. 3 is an exploded view of the pump assembly in FIG. 4. The pump mechanism 80 is in fluid communication with a flowable material contained in reservoir 90 which may be dispensed through the orifice 28. The pump mechanism comprises a piston 82 and a spring 84. The button portion comprises a molded portion 30 on the underside of the button portion 20 that allows movement of the piston 82 in order to actuate a pump mechanism 80. In this embodiment, the piston 82 is not shown in the exploded view as it is contained within the molded portion 30 on the interior of button portion 30. The bottom of the collar portion 66 is adapted to the top of the reservoir cage 97 to mechanically secure the pump assembly. The reservoir 90 comprises a locking and aligning feature 92 to align and lock to a complementary element on the interior of assembled actuator 10. The spring 84 allows the button portion to be returned substantially to its original position once actuation is complete.

Figure 5:
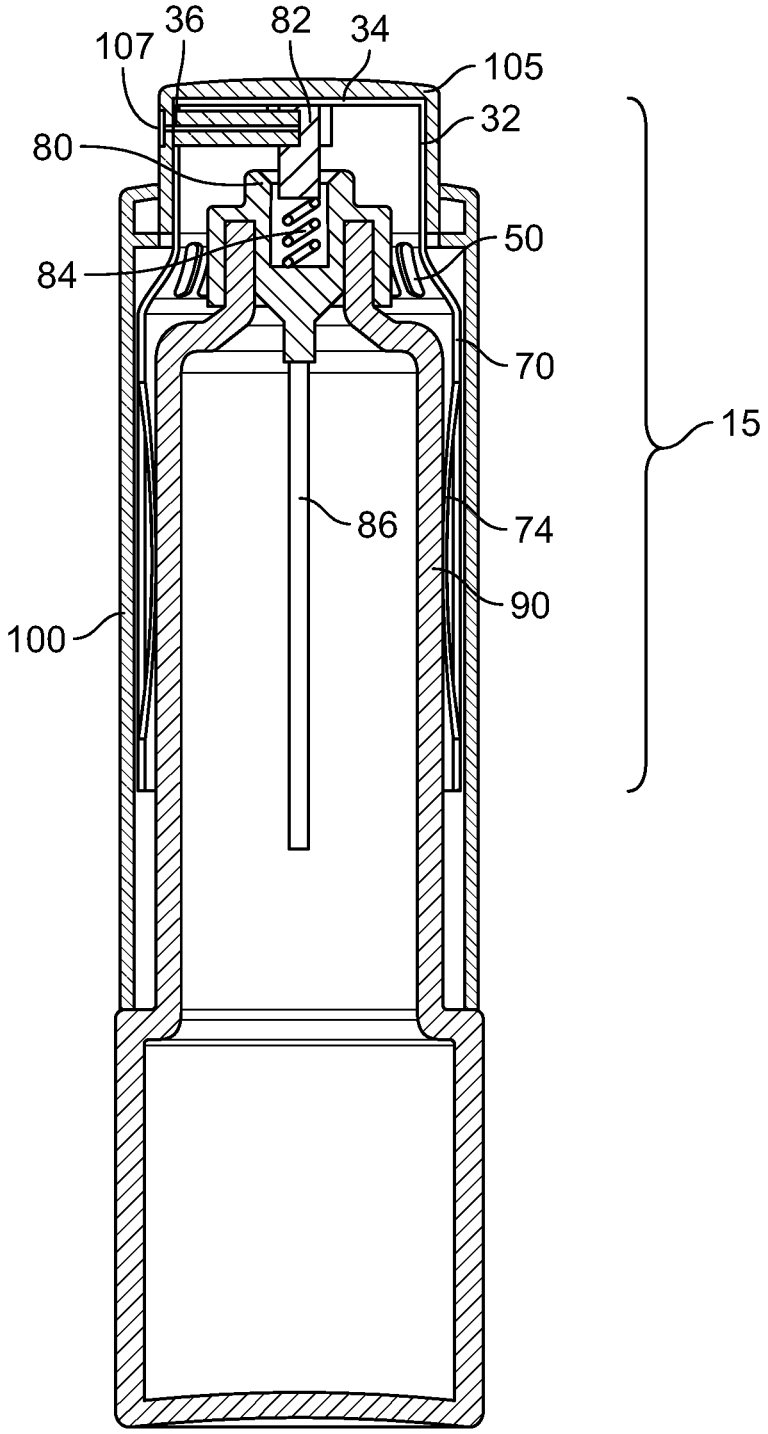
FIG. 5 is a cross sectional side view of another embodiment of another pump assembly of the current invention.
Figure 6:
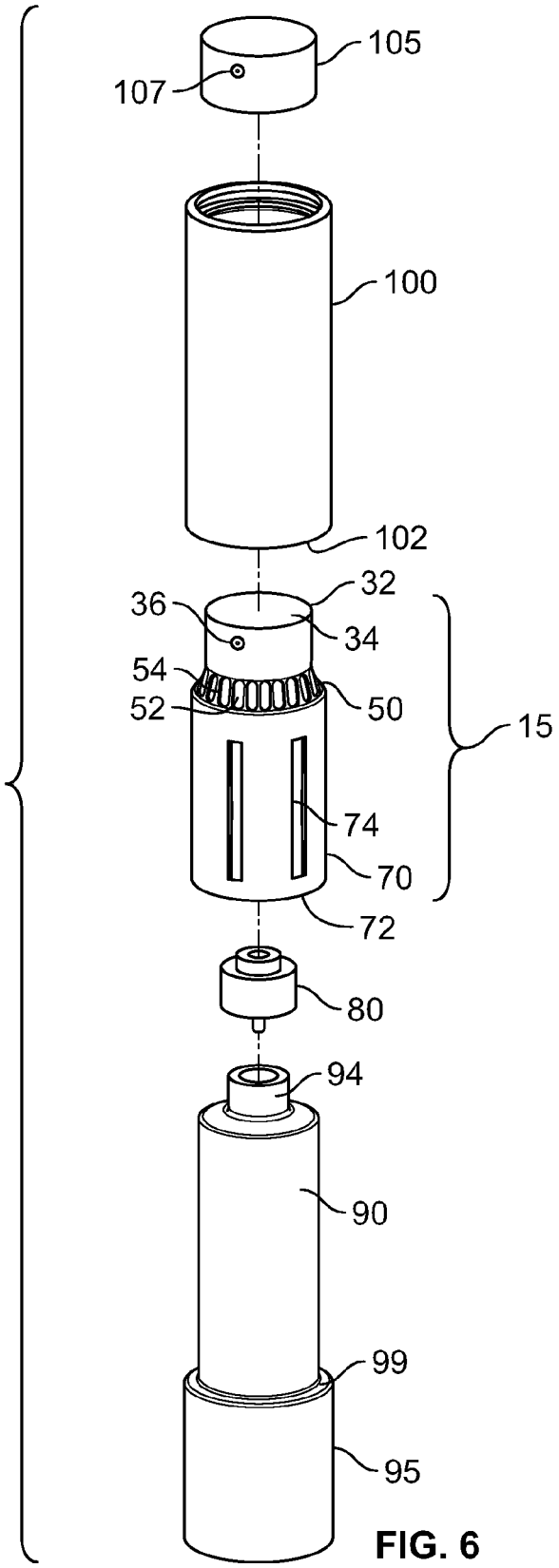
FIG. 6 is an exploded view of the pump assembly of FIG. 5.

Referring to FIGS. 5 and 6, an embodiment of the invention in which the elastomeric actuator 15 is engaged indirectly is shown. FIG. 6 is an exploded view of the embodiment shown in FIG. 5. As illustrated, the pump assembly comprises a cap 105, a securing cylinder 100, an elastomeric actuator 15, a pump mechanism 80, a reservoir 90 and a cage 95. The elastomeric actuator 15 comprises a button portion 32 comprising an annular shape with a generally discoid top surface 34 that is actuated indirectly through a user's finger onto cap 105. The button portion further comprises an exit orifice 36 designed to align with an exit orifice 107 on cap 105. The elastomeric actuator 15 further comprises a living hinge 50, comprising rounded rectangular voids 52 and bands of material 54. Between the rounded rectangular voids 52 are the bands of material 54 with a width smaller than the width of the voids. The collar portion 70 includes a design feature 74 comprising a cutout and rounded band of material designed to allow flexibility of the actuator 15 and help secure it to reservoir 90. Securing cylinder 100 has a bottom 102 that is adapted to mechanically secure to a feature 99 on cage 95. The interior of reservoir 90 comprises a dip tube designed to be submerged beneath the surface of a flowable composition contained within the reservoir 90 to allow fluid communication with pump mechanism 80.

Any type of injection molding process can be used to manufacture the pump actuator. In some embodiments, the pump actuator is manufactured by bi-injection molding. In some embodiments, insert molding is used. In some embodiment, thin-wall injection molding is used. In some embodiments the pump actuator is 3D printed.

The pump actuator may comprise any material capable of creating a living hinge. In some embodiments, the actuator comprises a polyolefin plastic, such as polypropylene. The material may be a polymer with intrinsic elastomeric properties, such as an elastomer. Suitable elastomers also include unsaturated and saturated rubbers. Unsaturated rubbers may be natural polyisoprene, synthetic polyisoprene, polybutadiene, chloroprene, butyl rubber, styrene-butadiene, nitrile rubbers, hydrogenated nitrile rubbers. Saturated rubbers may be ethylene propylene rubber, ethylene propylene diene rubber, epichlorohydrin rubber, polyacrilyc rubber, silicone rubber, fluorosilicone rubber, fluoroelastomers (e.g., Viton, Tecnoflon, Fluorel, Aflas and Dai-El), perfluoroelastomers (e.g., PFR, Kalrez, Chemraz, Perlast), polyether block amides, chlorosulfonated polytethylene, ethylene-vinyl acetate, and combinations thereof. In some embodiments, the entire pump actuator is made from an elastomer. In some embodiments, the pump actuator comprises a resin. In some embodiments, the entire pump actuator is composed of a resin. Suitable resins may be synthetic or natural resins. Suitable resins may be any linear or branched polymer resin. Examples of suitable resins are epoxy, polyurethane, methyl methacrylate, acetal, melamine, nylon, polyamide, polypropylene, polyethylene resins and combinations thereof. In some embodiments, the actuator comprises multiple materials.

The actuator may be used to actuate any pump capable of moving a flowable composition. The flowable composition may be a gel, an emulsion, a liquid, a gas, a colloidal suspension, etc. The pump may atomize the flowable composition. The pump may aerate the flowable composition. The pump may be, for example, a spray pump, an atomizer, a mist spray pump, an aerator pump, etc. In some embodiments, the pump is an airless pump. In some embodiments the pump is an atmospheric pump comprising one or more one-way valves, a dipstick, a pump reservoir, a piston and a spring.

For example, in an atmospheric pump, atmospheric pressure on the surface of a flowable composition forces the flowable composition up a dip tube with an opening placed beneath the surface of the flowable composition. The flowable composition fills a pump reservoir connected between the exit orifice and the dip tube. Between this pump reservoir and the dip tube is a one way valve that only allows flowable materials to move in the single direction from dip tube to pump reservoir. In some embodiments, a second one way valve keeps the flowable composition in the second reservoir and only allows flow from the pump reservoir toward the exit orifice when actuation occurs. Upon actuation, a spring is compressed and a piston moves to decrease the size of the second reservoir. As a consequence, the flowable composition is forced through the second one way valve and exit orifice of the device. The one way valve between the second reservoir and the dip tube prevents movement of the flowable material back into the original location of flowable material (i.e. the dip tube and original reservoir). After removal of the actuating force, the compressed spring decompresses and moves the piston and actuator back to their original positions, causing volume of the second reservoir to increase. Flowable liquid is then drawn up from the dip tube to refill the second reservoir because of atmospheric pressure on the surface of the flowable composition. The first one way valve is opened while the second one way valve is not (the second one way valve prevents air from flowing through the exit orifice) to cause the flow of material from the original reservoir and dip tube to the pump reservoir. In some embodiments of the invention, the actuator is capable of moving the piston in an atmospheric pump. In other embodiments, the actuator is capable of moving both the spring and piston in an atmospheric pump. In some embodiments, the actuator further comprises the piston portion of an atmospheric pump. In some embodiments the actuator further comprises the piston and spring portions of an atmospheric pump. In some embodiments, the living hinge is capable of returning the actuator substantially to its original assembled position without the use of spring decompression force following an actuating force applied to the actuator. In some embodiments, both the spring decompression force and the living hinge elasticity return the actuator to its original assembled position following an actuating force applied to the actuator.

Figure 7A:
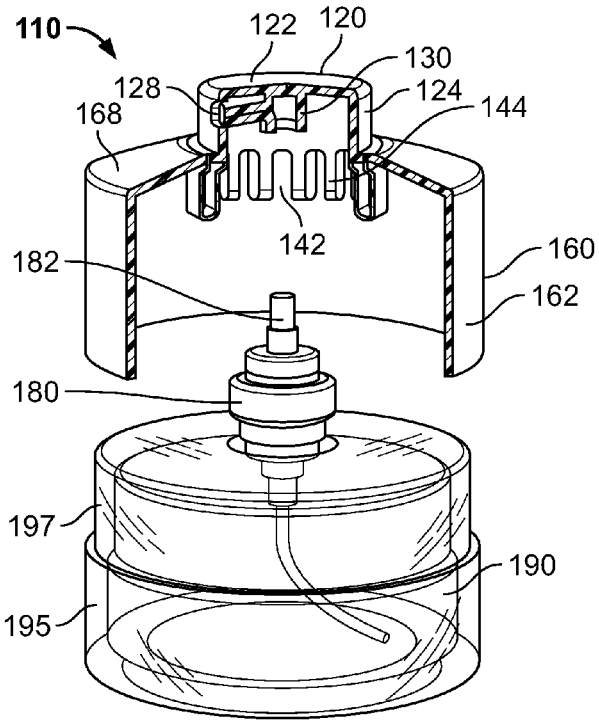
FIGS. 7A and 7B are perspective views showing a partial cross section of an embodiment of the current invention separated and attached to a dispenser assembly.
Figure 7B:
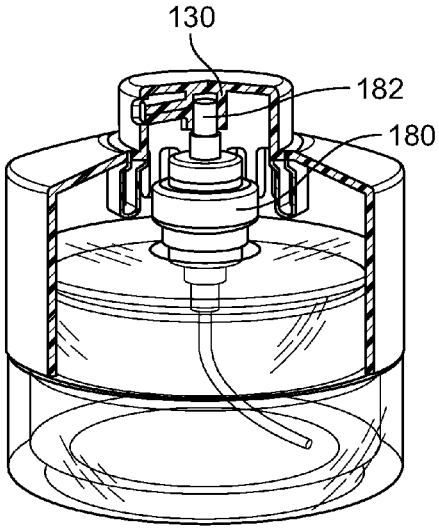

Referring to FIGS. 7A and 7B, an embodiment of the elastomeric actuator where the collar portion is not attached permanently to the cage is shown. An elastomeric actuator 110 is placed on a pump assembly 180 comprising piston 182 that is geometrically matched with feature 130 on the underside of the top surface 122 of the button portion 120. In this embodiment, the cage 190 comprises a base portion 195 and an attachment portion 197. The internal diameter of the lumen on collar portion 160 is approximately the same as the diameter of the attachment portion 197 of the cage 160 such that the collar fits snuggly onto the cage. The collar portion 160 may be moved vertically about the attachment portion 197.

Figure 8A:
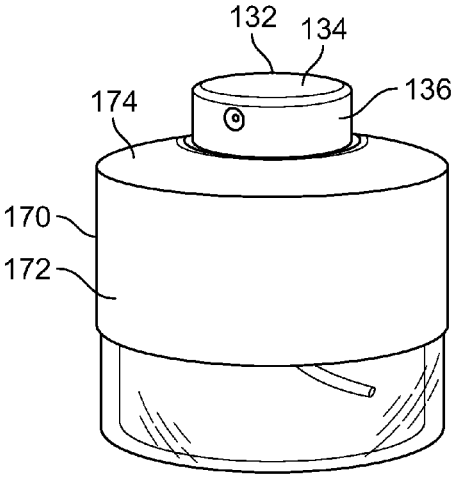
FIGS. 8A and 8B are perspectives views of another embodiment of the current invention showing a conversion from an actuating position (FIG. 8A) into a locked position (FIG. 8B).
Figure 8B:
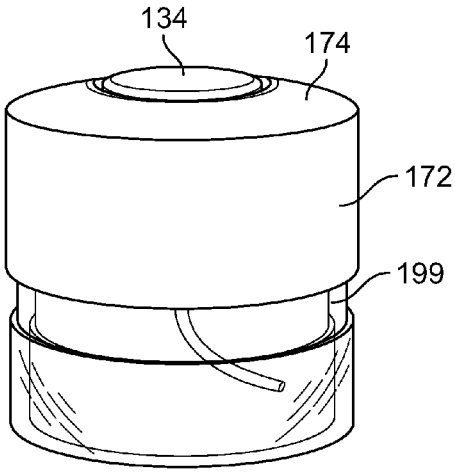

The assembled configuration may comprise multiple positions each of which allows different a different functionality to the elastomeric actuator. The assembled configuration of the elastomeric actuator may comprise a locked position which prevents actuation and an actuating position which allows for actuation of the pump. Referring to FIGS. 8A and 8B, an embodiment of the current invention comprising multiple positions of the assembled configuration is shown. In the actuation position of FIG. 8A, the collar portion 170 extends the length of the attachment portion of the cage. The exit orifice and wall surface 136 of the button portion 132 are visible. In the locked position of FIG. 8B, the column portion 170 is moved vertically such that the top surface 174 of the collar portion 170 is nearly the same height as the top surface 134 of the button portion and a surface 199 of the attachment portion is visible. In the transition from locked position to actuating position and from actuating position to locked position, the distance of the top surface 134 to the bottom of the cage remains unchanged. Only the column portion slides along the attachment portion of the cage. This sliding may be made possible by a living hinge within the device. This may be the same living hinge that is used in the pump actuation or a different living hinge from the hinge used to actuate the pump. In some embodiments of the pump actuator, while in the locked position, the button portion cannot be depressed and actuation of the pump mechanism cannot occur.

The elastomeric actuator or each portion of the elastomeric actuator may be of any shape. For example, in any plane perpendicular to a plane which contains the center of the button portion, the center of the sleeve portion and the center of the collar portion, the cross section of the elastomeric actuator may be circular, square, trigonal, trapezoidal, rhomboidal, polygonal, etc. In some embodiments, any portion of the elastomeric actuator may be circular, square, rectangular, trigonal, trapezoidal, rhomboidal, polygonal, etc., in this perpendicular plane and any other portion may have another shape. In some embodiments, the collar portion and the button portion have different geometrical shapes. In some embodiments, they have the same shape. For example, in some embodiments, the collar portion is rectangular in this perpendicular plane and the button portion is circular in this plane. In other embodiments, both the collar portion and the button portion are circular in this plane.

The flowable composition may be any material capable of being dispensed through an orifice through a pump mechanism. In some embodiments, the orifice is a spray nozzle. The spray nozzle may have any shape or design. For example, the spray nozzle may be a plain-orifice nozzle, a shaped-orifice nozzle, a surface-impingement-single-fluid nozzle, a solid-cone single-fluid nozzle, a compound nozzle, an internal-mix two-fluid nozzle, an external-mix two fluid nozzle, an atomizer, a rotary atomizer, an ultrasonic atomizer or an electrostatic nozzle. In some embodiments the nozzle is molded in the elastomeric actuator during the molding process of the elastomeric actuator. In some embodiments, the nozzle is inserted into the elastomeric actuator following the molding process of the elastomeric actuator. The exit orifice may be located on any portion of the pump actuator such that a flowable composition may be expelled therethrough. For example, in some embodiments, the exit orifice is located on the collar portion. In other embodiments, the exit orifice is located on the button portion.

The flowable composition may be any suitable personal care product. The flowable composition may be a perfume, body wash, face wash, body oil, body lotion or cream, anti-aging cream or lotion, body gel, day cream or lotion, night cream or lotion, treatment cream, skin protection ointment, moisturizing gel, body milk, suntan lotion, suntan cream, self-tanning cream, artificial tanning composition, cellulite gel, peeling preparation, facial mask, depilatories, shaving cream, deodorant, anti-persipirant, and the like, particularly for topical application to a human integument. The personal care product may comprise a volatile material. The flowable composition may comprise a fragrance oil. Any fragrance oil can be used in the flowable composition, such as those described in U.S. Patent Application Publication No. 2013/0290409 or U.S. Pat. No. 8,921,303, hereby incorporated by reference in their entirety. The fragrance oil may be an oil that is used primarily for aesthetic benefits (e.g., a perfume) or may have functional benefits (e.g., an insect repellant). Other suitable fragrance oils are those listed in U.S. Patent Application Publication Nos. 2012/0107529 and 2013/0202788, and U.S. Pat. No. 7,294,612, which are incorporated by reference in their entirety herein. The compositions may comprise any insect repellant oil or oils, including, for example, essential oils of citronella, catnip, and lavender; neem seed oil, and soy oil. Other suitable insect repellant oils are those listed in PCT Application Pub. No. WO/2003013243; U.S. Pat. No. 8,501,205; and U.S. Application Pub. No. 2013/0084347, which are incorporated by reference in their entirety herein.

While the invention has been described in conjunction with specific embodiments, it is to be understood that many alternatives, modifications, and variations will be apparent to those skilled in the art in light of the foregoing description.

The invention claimed is:

1. A pump actuator comprising:

a button portion;

a collar portion having a top end, a bottom end, and a continuous wall defining a lumen therein; and an elastomeric sleeve connecting said button portion to said collar portion;

wherein said button portion, collar portion, and sleeve are formed from a single mold in a molded configuration in which the button portion is separated from the top end of said collar portion by said sleeve;

wherein the actuator is capable of being configured in an assembled configuration wherein said sleeve collapses within said lumen to provide a living hinge;

wherein said actuator, in the assembled configuration, is configured to be depressed by an actuating force applied from a user's fingers to said button portion to cause a valve of a pump to be opened, and said living hinge is sufficiently pliable to allow said button to be depressed within said lumen.

2. The pump actuator of claim 1 wherein said collapsed sleeve is sufficiently elastic to cause said depressed button portion to return substantially to its original assembled configuration after said actuating force is removed.

3. The pump actuator of claim 1, wherein said button portion comprises an orifice for dispensing a flowable material.

4. The pump actuator of claim 1, wherein said elastomeric sleeve comprises polypropylene.

5. The pump actuator of claim 1, wherein said pump actuator is composed of polypropylene.

6. The pump actuator of claim 1, wherein said pump actuator is bi-injection molded, such that at least one of said button, collar or sleeve portions differs in polymeric composition from the other two portions.

7. The pump actuator of claim 1, wherein said button portion is sufficiently pliable to be deformed by force from a user's fingers and can return substantially to its original shape upon removal of said force.

8. The actuator according to claim 1 wherein said pump is an atmospheric pump.

9. The pump actuator of claim 1, wherein said button portion comprises on its underside a molded feature for engaging a piston and/or dip tube.

10. The actuator according to claim 1, wherein said button portion comprises a generally discoid shaped surface.

11. The pump actuator of claim 1, wherein said collar portion is adapted to be secured to a container, and is configured to be separable from said container.

12. The actuator according the claim 1, wherein said collar portion has a generally annular wall.

13. The pump actuator of claim 1, wherein said sleeve comprises engineered faults which facilitate the collapse of said sleeve in the assembled configuration.

14. The pump actuator of claim 13, wherein said engineered faults are slits or voids in the sleeve.

15. The pump actuator of claim 13, wherein said engineered faults comprise a plurality of elongated voids equally spaced around the periphery of the sleeve.

16. The pump actuator of claim 15, wherein said plurality of elongated voids form a band of elastomeric material between any two adjacent voids, wherein the length of said band is substantially greater than the width defined by the distance adjacent voids.

17. The pump actuator of claim 16, wherein said plurality of elongated voids are oriented such that the elongated dimension is substantially parallel with an axis defined by a center of the collar portion and a center of the button portion.

* * * * *